US008517623B2

(12) United States Patent
Cavaiani

(10) Patent No.: US 8,517,623 B2
(45) Date of Patent: Aug. 27, 2013

(54) MOLDED SOAP BAR FOR STORING AND DISPENSING LIQUID SOAP

(76) Inventor: Charles A. Cavaiani, Placentia, CA (US)

( * ) Notice: Subject to any disclaimer, the term of this patent is extended or adjusted under 35 U.S.C. 154(b) by 433 days.

(21) Appl. No.: 12/806,477

(22) Filed: Aug. 12, 2010

(65) Prior Publication Data

US 2011/0052306 A1 Mar. 3, 2011

Related U.S. Application Data

(60) Provisional application No. 61/275,222, filed on Aug. 22, 2009.

(51) Int. Cl.
*B43K 5/18* (2006.01)

(52) U.S. Cl.
USPC ..... 401/264; 401/183; 401/186

(58) Field of Classification Search
USPC ..... 401/183–186, 261–264
See application file for complete search history.

(56) References Cited

U.S. PATENT DOCUMENTS 3,880,532 A * 4/1975 O'Hare ..... 401/292
4,098,434 A * 7/1978 Uhlig ..... 222/94
5,120,148 A * 6/1992 Waters et al. ..... 401/264

* cited by examiner

*Primary Examiner* — David Walczak
(74) *Attorney, Agent, or Firm* — Morland C. Fischer

(57) ABSTRACT

A molded soap bar having a flexible outer shell and a flexible soap reservoir lying within the outer shell and containing liquid soap to be dispensed. The soap reservoir communicates with a button valve by way of a soap emitter that is surrounded by a soap dispensing head which lies outside and below the flexible outer shell. A squeezing force applied to the flexible outer shell of the molded soap bar is transmitted to the flexible soap reservoir to cause soap to be delivered under pressure from the reservoir through a flow path formed in the soap emitter to the button valve. The button valve includes a flexible flap closure that is pivotally connected to the soap dispensing head and a pushing arm that is connected to the flap closure. A pushing force applied to the pushing arm causes the flap closure of the button valve to pivot from a closed position to an open position to create a gap through which a supply of liquid soap from the soap reservoir is dispensed.

13 Claims, 4 Drawing Sheets

MOLDED SOAP BAR FOR STORING AND DISPENSING LIQUID SOAP

This application is related to Provisional Patent Application No. 61/275,222 filed Aug. 27, 2009.

BACKGROUND OF THE INVENTION

1. Field of the Invention

This invention relates to a molded (e.g., liquid silicone rubber) soap bar having the shape of a conventional solid soap bar and carrying a supply of liquid soap to be dispensed via a button valve mounted on a soap dispensing head in response to a pushing force applied to the valve by a user.

2. Background Art

Conventional solid hand and bathing soap bars are known to be entirely consumed following use. In many cases, however, the soap bar is only partially consumed or subject to a distortion or a change in shape. Because of its slippery nature when wet, the conventional soap bar is sometimes dropped and broken into pieces. The soap bar may also become soggy and distorted as a consequence of prolonged exposure to water. The resulting size and shape can cause the bar or its pieces to become unmanageable or aesthetically unappealing. Consequently, the bar and/or one or more of the bar pieces will be prematurely discarded resulting in waste and the necessity of having to purchase a replacement bar sooner than expected.

Moreover, if one is left in standing water, a conventional solid soap bar is known to become soft and mushy which often leads to soap solids becoming liquefied and creating running dispersions in soap trays, bath tubs and shower stalls. Not only will a thick residue, often referred to as soap scum, be left behind, but a hazardous condition may be created for the next bather or shower taker. Depending upon its use, a wet bar can collect body hairs, skin cells, dust and therefore become undesirably contaminated. In this same regard, once a wet bar has dried and been exposed to warm conditions, it often becomes hard and develops cracks which can make reuse difficult or uncomfortable.

On occasion, one showering or bathing may wish to exfoliate his skin to achieve a deep cleaning effect. Whether a conventional soap bar or a source of liquid soap is employed, the user is required to also have access to a scrub brush, a mesh or loofah sponge, an exfoliating mitt, or the like. The application of soap to the user's skin and the retrieval and manipulation of the exfoliating tool can lead to an awkward activity.

SUMMARY OF THE INVENTION

In order to avoid the shortcomings associated with using a conventional solid soap bar for bathing and while exfoliating one's skin in the manner described above, a molded soap bar is disclosed within which to store and from which to dispense a supply of liquid soap. The molded soap bar ideally has the shape of a conventional solid soap bar. The soap bar of this invention includes a flexible outer shell that is preferably blow-molded from a liquid silicone rubber so as to include sets of scrubbing ribs and ridges along the top and bottom thereof. The flexible outer shell is molded around a two-piece substrate. Located within the substrate is a flexible soap reservoir (e.g., a bag) in which liquid soap is stored to be dispensed to a user when a compressive squeezing force is applied by the user to the flexible outer shell so that a corresponding compressive force is transmitted to the soap reservoir.

A flow regulating soap emitter is housed within an emitter compartment of a soap dispensing head that extends below the bottom of the molded soap bar by way of an opening formed in the outer shell. A neck of the soap reservoir communicates with the soap emitter through an aperture formed in the substrate within which the reservoir is located. A soap collection area of the soap dispensing head lies outside the soap emitter. When a compressive force is applied to the flexible outer shell of the molded soap bar, liquid soap is forced, under pressure, from the soap reservoir into the soap collection area of the soap dispensing head via the soap emitter.

The liquid soap is dispensed from the soap collection area at a normally closed button valve formed in the soap dispensing head. The button valve has an upstanding pushing arm connected to a flexible flap closure that has a spring memory and is pivotable relative to the soap dispensing head from a closed position, at which to prevent liquid soap from leaking from the soap dispensing head, to an open position, at which liquid soap can be dispensed to the user's skin. When the flexible outer shell of the molded soap bar is compressed and a pushing force is simultaneously applied to the pushing arm of the button valve, the flap closure is caused to pivot from its closed position to its open position so that a gap is established through the valve to the soap collecting area of the soap dispensing head through which the liquid soap is dispensed. When the pushing force is removed from the pushing arm of the button valve, the flap closure will automatically return (i.e., pivot) to its original closed position so that the gap is closed and the flow of liquid soap will be interrupted.

DESCRIPTION OF THE PREFERRED EMBODIMENT

Figure 1:
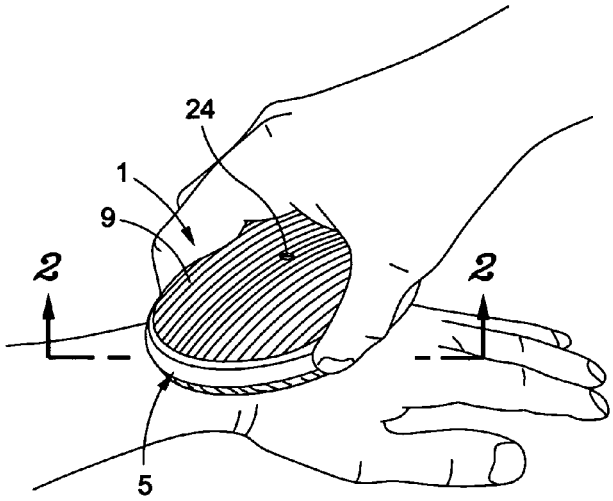
FIG. 1 shows a molded soap bar according to a preferred embodiment of this invention being compressed by one hand of a user so that liquid soap stored within the soap bar can be dispensed therefrom.

There is shown in FIG. 1 of the drawings a molded soap bar 1 within which a supply of liquid soap (designated 3 in FIG. 4) is carried and stored. As will be explained in greater detail hereinafter, the molded soap bar 1 is responsive to a compressive force applied thereto by one hand of a user in which the soap bar is held so that a measured amount of the liquid soap can be dispensed to the user's other hand or directly to the user's skin for washing purposes. As will be explained, the soap bar 1 is a fully self-contained system that is capable of both dispensing a measured supply of the liquid soap 3 and scrubbing the user's skin for an exfoliating advantage.

Details of the molded soap bar 1 according to a preferred embodiment of this invention are described while referring to FIGS. 2-5 of the drawings. For aesthetic reasons, the molded soap bar 1 has an appearance to resemble that of a typical solid bar of soap. However, the actual shape of the soap bar 1 should not be considered a limitation of this invention. In this regard, a flexible (i.e., resilient) outer shell 5 establishes and maintains the external shape of the soap bar 1. The flexible outer shell 5 of the soap bar 1 is preferably blow-molded from a hypoallergenic medical grade liquid silicone rubber or similar material.

Figure 2:
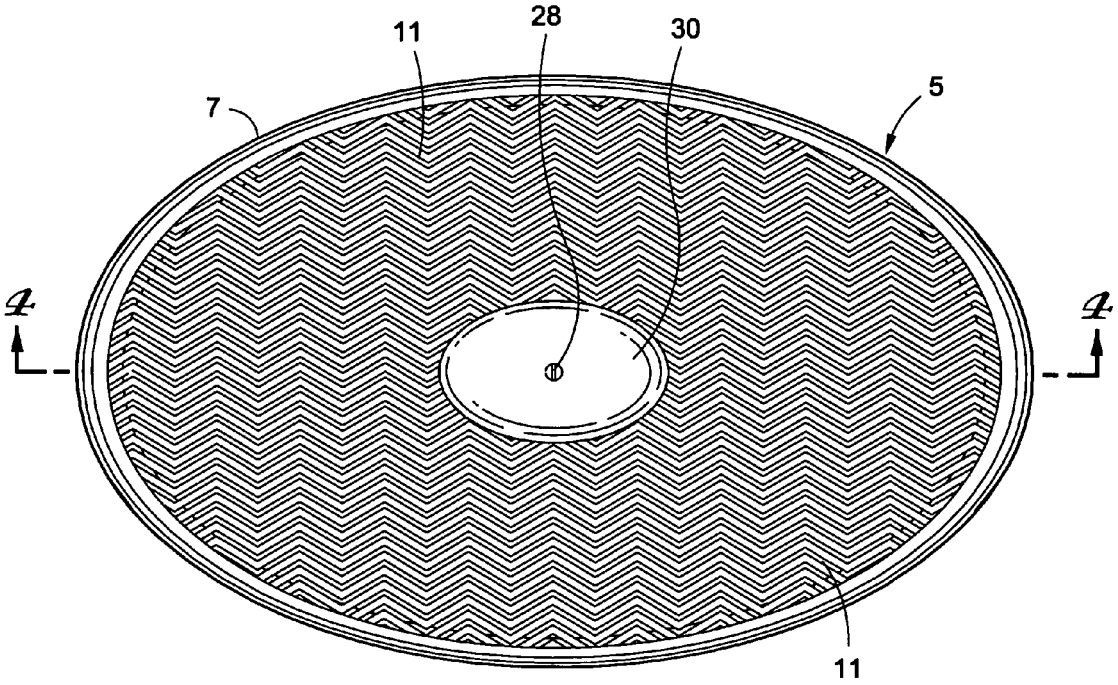
FIG. 2 is a side view of the molded soap bar of FIG. 1.
Figure 3:
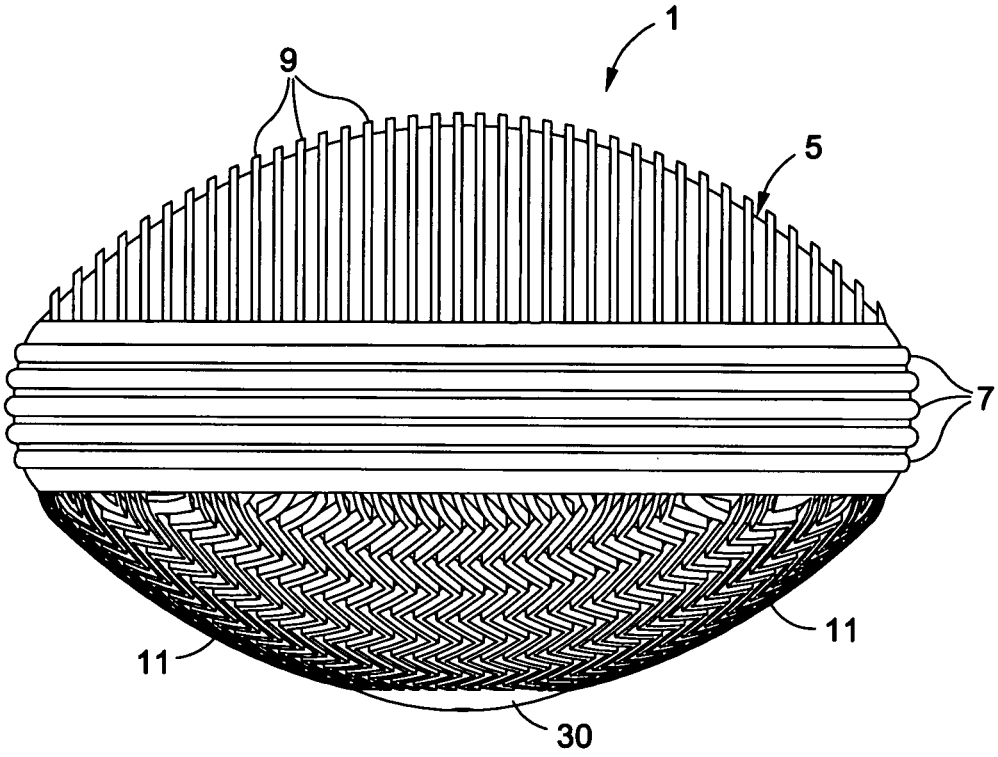
FIG. 3 is a bottom view of the molded soap bar of FIG. 1.

As is best shown in FIGS. 2 and 3, the outer shell 5 has an extruded external surface to enhance the scrubbing and cleaning effect achieved when the bar 1 is rubbed against the user's skin after the application of liquid soap thereto. To enable the soap bar 1 to be easily handled, a set of relatively thick, parallel aligned gripping ribs 7 extend around the front, back and opposite sides of the outer shell 5. A set of relatively thin, parallel-aligned scrubbing ribs 9 run over the top of the outer shell 5 above the gripping ribs 7. A set of zig-zag scrubbing ridges 11 run over the bottom of the outer shell below the gripping ribs 7. Thus, it can be appreciated that the gripping ribs 7 surround the outer shell 5 of the soap bar 1 so as to lie between the scrubbing ribs 9 at the top and the scrubbing ridges 11 at the bottom.

The parallel-aligned scrubbing ribs 9 and the zig-zag scrubbing ridges 11 provide different tactile sensations when the molded soap bar 1 is rubbed over and against the user's skin. Moreover, different (i.e., deeper) scrubbing and cleaning effects can be achieved depending upon the needs of the user and the force applied to by user to the soap bar.

Figure 4:
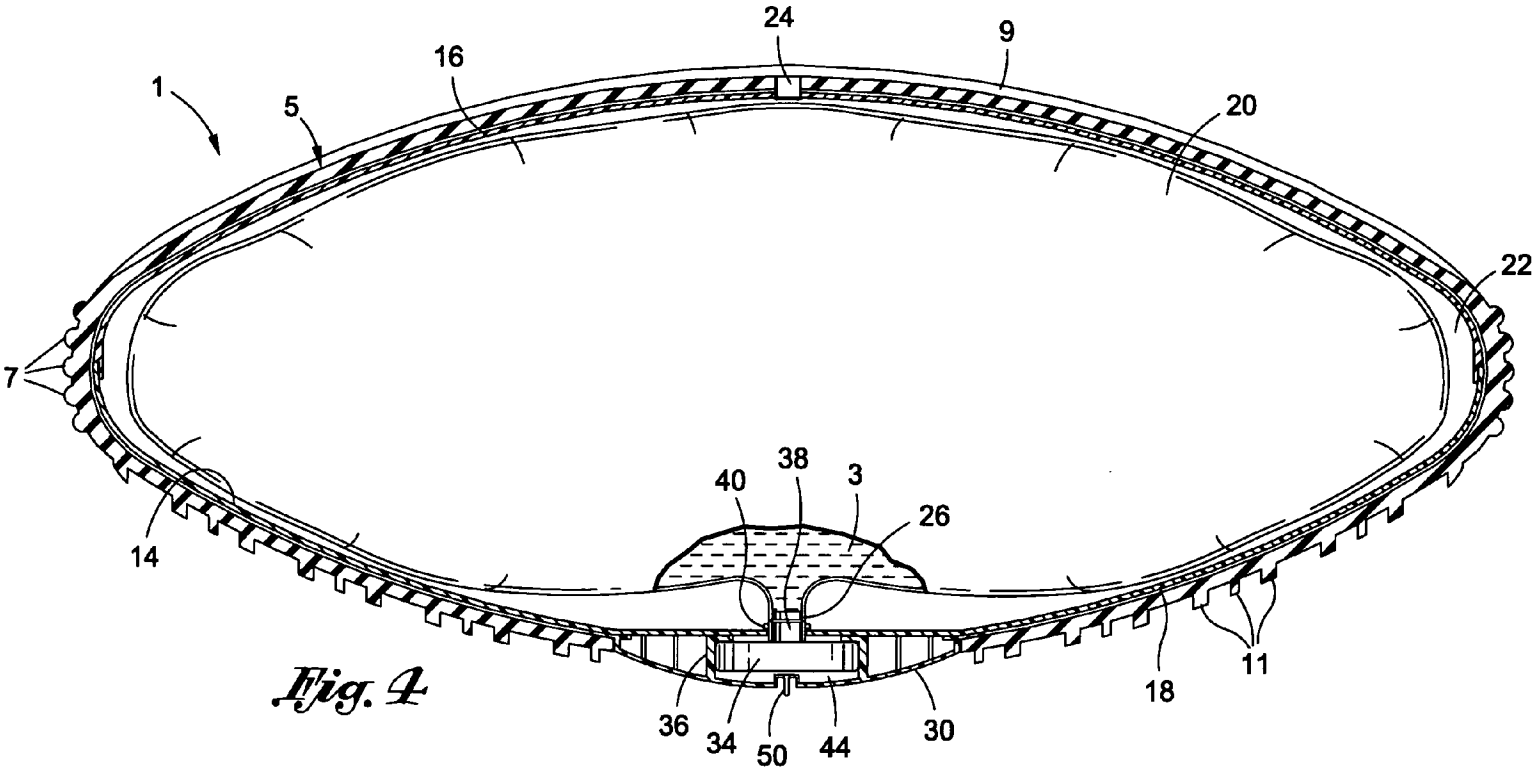
FIG. 4 is a cross-section of the molded soap bar taken along lines 4-4 of FIG. 2.
Figure 5:
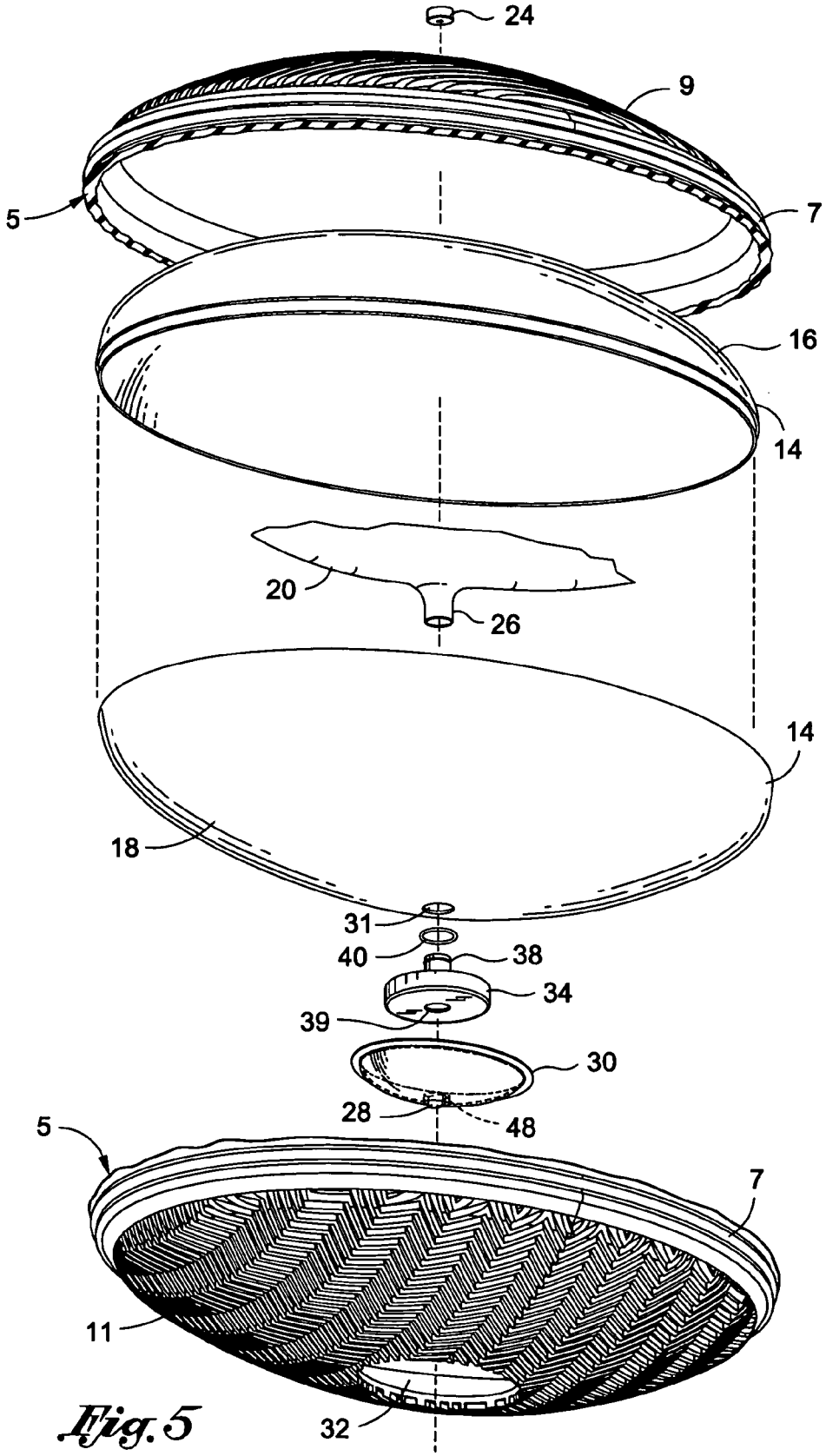
FIG. 5 is an exploded view of the molded soap bar.

Referring in particular to FIGS. 4 and 5 of the drawings, a two-piece flexible inner substrate 14 is shown having opposing halves 16 and 18 around which the outer shell 5 of the soap bar 1 is continuously molded. By way of example, the inner substrate 14 is manufactured from a high density polyethylene or similar material, and the outer shell 5 is molded around the substrate 14 within a clam shell mold, or the like. The flexible outer shell 5 has a resilient characteristic so that it and the inner substrate 14 are adapted to automatically return to their original shape (as shown) following the application of a compressive squeezing force to shell 5 by the user when it is desirable to dispense liquid soap from the soap bar 1.

A thin, flexible (e.g., polyethylene) soap reservoir or bag 20 within which the liquid soap 3 is stored is disposed inwardly of and surrounded by the flexible outer shell 5 and the flexible inner substrate 14 of the molded soap bar 1. The soap reservoir 20 is dimensioned so that an air space 22 is established between the reservoir 20 and the inner substrate 14. A normally closed check valve 24 (e.g., a wedge grommet) extends through the top of the outer shell 5 and the inner substrate 14 so as to communicate with the air space 22. When a compressive squeezing force is applied to the soap bar 1, the shape of the outer shell 5 is distorted and a corresponding compressive force is applied to the soap reservoir 20 so that a supply of liquid soap 3 will be expulsed therefrom in a manner that will soon be described. When the compressive force is terminated, the resilient outer shell 5 automatically returns to its normal pre-compressed shape as air is suctioned from the atmosphere into the air space 22 via the check valve 24.

The flexible soap reservoir 20 includes a neck 26 that lies in fluid communication with a normally closed button valve 28 that is located on a soap dispensing head 30 at the bottom of the molded soap bar 1. Details of the button valve 28 will be provided when referring to FIGS. 6 and 7. The soap dispensing head 30 projects outwardly from and below the outer shell 5 by way of an opening 32 formed therein (best shown in FIG. 5). In this manner, the normally closed button valve 28 carried by the soap dispensing head 30 will be accessible in order to contact the user's skin so that the valve 28 can be opened in response to a pushing force applied thereto, whereby to selectively permit the flow of liquid soap 3 from the soap reservoir 20 to the user.

The soap reservoir 20 communicates with the button valve 28 by way of a disk-shaped flow regulating emitter 34 that is disposed within a rigid emitter compartment 36 of the soap dispensing head 30. In particular, a cylindrical inlet port 38 extends from the emitter 34, through an aperture 31 formed in the substrate 14, and into receipt by the neck 26 of soap reservoir 20. A narrow (relative to the neck 26 of soap reservoir 20) cylindrical flow path 39 (best shown in FIG. 5) runs through the emitter 34 and the inlet port 38 extending therefrom. The size (i.e., diameter) of the flow path 39 and the viscosity of the liquid soap stored within the soap reservoir 20 controls (i.e., limits) the rate and volume of soap to be dispensed from the soap bar 1 to avoid dispensing an excessive amount of soap. A clamping ring 40 surrounds the neck 26 of soap reservoir 20 inside the substrate 14 and holds the neck 26 against the inlet port 38 of the emitter 34. The ring 40 creates a fluid-tight seal between the neck 26 and the inlet port 38 to ensure a smooth and continuous supply of liquid soap 3 from the soap reservoir 20, through the flow path 39, and to the button valve 28.

In this regard, a soap collection area 44 (best shown in FIG. 4) lies within the emitter compartment 36 of the soap dispensing head 30 below the emitter 34. As previously described, a compressive force applied to the flexible outer shell 5 of the molded soap bar 1 is transmitted through the substrate 14 to the soap reservoir 20. A corresponding compressive force applied to the soap reservoir 20 forces the liquid soap 3 to flow, under pressure, into the neck 26 of reservoir 20 and through the flow path 39 (of FIG. 5) of the inlet port 38 and the emitter 34 for receipt by the soap collection area 44 of the emitter compartment 36. The soap received at the soap collection area 44 can be dispensed into the hand or onto the skin of the user from the button valve 28 of the soap dispensing head 30 in a manner that will now be disclosed while referring to FIGS. 6 and 7 of the drawings.

Figure 6:
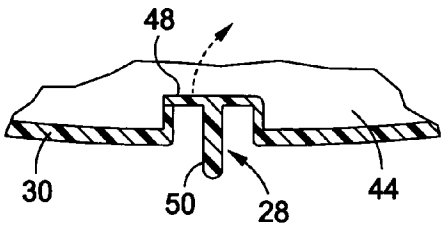
FIG. 6 shows a soap dispensing button valve of the molded soap bar in a closed position.
Figure 7:
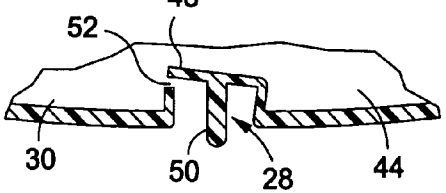
FIG. 7 shows the soap dispensing button valve in an open position.

FIG. 6 shows the button valve 28 in its normally closed position at which to prevent the unintended leaking of liquid soap from the soap collection area 44 of the soap dispensing head 30. The button valve 28 includes a flexible flap closure 48 having a spring memory and a pushing arm 50 which is connected to and stands upwardly from the flap closure 48 so as to project outwardly from the soap dispensing head 30 below the bottom of the molded soap bar. One end of the flap closure 48 of button valve 28 is co-extensively and hingedly connected to the soap dispensing head 30. The opposite end of the flap closure 28 is pivotable from the closed position of FIG. 6, when there is no pushing force being applied to the pushing arm 50 of button valve 28, to an open position of FIG. 7, when a pushing force is being applied to the pushing arm 50. That is to say, when it is desirable to dispense a supply of liquid soap to the user, the flexible outer shell 5 of the molded soap bar 1 is squeezed. At the same time, the soap dispensing head 30 is pressed against the user's hand or skin to be washed. Accordingly, a pushing force is applied by the user to the pushing arm 50 of the button valve 28. The pushing force is transferred from the pushing arm 50 to the flexible flap closure 48, whereby the flap closure is caused to pivot from its closed position (of FIG. 6) to its open position (of FIG. 7).

With the flap closure 48 moved to its open position, a gap 52 is created between the flap closure and the soap dispensing head 30. Inasmuch as the liquid soap within the soap collection area 44 of soap dispensing head 30 is under pressure, the soap will flow through the gap 52 of button valve 28 to the user's hand or skin. The soap will continue to flow until the pushing force applied to the pushing arm 50 is removed, whereby the button valve 28 will return to its closed position. In this case, the spring memory causes the flap closure 48 to automatically pivot to its original position of FIG. 6 so that the gap 52 is closed and the flow of liquid soap will be interrupted. Once the soap is applied to the user's skin, the molded soap bar 1 (of FIG. 3) can be manipulated in a hand of the user to enable the skin to be cleaned, rubbed or exfoliated by the scrubbing ribs 9 or scrubbing ridges 11 on an as-needed basis as earlier described.

The invention claimed is:

1. A liquid dispenser, comprising:

a flexible reservoir in which a liquid is stored;

a flexible outer shell surrounding said flexible reservoir;

a liquid dispensing valve having open and closed positions and lying in fluid communication with said flexible reservoir, said liquid dispensing valve being disposed in said closed position at which to block the flow of the liquid therethrough from said flexible reservoir to a location outside said flexible outer shell, said flexible outer shell being, responsive to a compressive force applied thereto to apply a corresponding compressive force to said flexible reservoir surrounded by said flexible outer shell so that at least some liquid is forced under pressure from said flexible reservoir to said liquid dispensing valve, and said liquid dispensing valve being responsive to a pushing force applied thereto to cause said valve to be disposed in said open position at which the liquid is dispensed to the location outside said flexible outer shell;

a liquid emitter located between said flexible reservoir and said liquid dispensing valve to establish a flow path therebetween, the volume of liquid supplied from said flexible reservoir to said liquid dispensing valve depending upon the size of the to path and the viscosity of the liquid stored in said flexible reservoir; and a liquid dispensing head positioned at the exterior of said flexible outer shell, said liquid emitter being surrounded by said liquid dispensing head, and said dispensing valve being carried by said liquid dispensing head, wherein there is a liquid collection area located within said liquid dispensing head and communicating with said liquid emitter such that the at least some liquid is delivered from said flexible reservoir to said liquid collecting area via the flow path established by said liquid emitter, said liquid dispensing valve dispensing the liquid from the liquid collection area within said liquid dispensing head when the compressive force is applied from said flexible outer shell to said flexible reservoir and said valve is disposed in said open position.

2. The liquid dispenser recited in claim 1, wherein said flexible reservoir is spaced inwardly from said flexible outer shell such that there is an air space lying therebetween.

3. The liquid dispenser recited in claim 2, further comprising a flexible substrate around which said flexible outer shell is molded, said flexible reservoir being spaced inwardly from said flexible substrate.

4. The liquid dispenser recited in claim 2, further comprising a chock valve extending through said flexible outer shell and communicating with the air space lying between said outer shell and said flexible reservoir to permit air to be suctioned from the atmosphere to said air space once the compressive force being applied to said flexible outer shell is terminated.

5. The liquid dispenser recited in claim 1, wherein there is molded into said, flexible outer shell a plurality of parallel-aligned scrubbing ribs.

6. The liquid dispenser recited in claim 5, wherein there is also molded into said flexible outer shell a plurality of zig-zag shaped scrub ridges.

7. The liquid dispenser recited in claim 6, wherein there is also molded into said flexible outer shell a plurality of parallel-aligned gripping ribs located between said scrubbing ribs and said scrubbing ridges, said gripping ribs providing a gripping surface at which said outer shell is gripped the hand of a user.

8. The liquid dispenser recited in claim 1, wherein said flexible reservoir communicates with said liquid dispensing valve by way of an opening formed in said flexible outer shell.

9. The liquid dispenser recited in claim 8, wherein said flexible reservoir has a liquid dispensing neck, said neck communicating with said liquid dispensing valve by way of the flow path established by said liquid emitter.

10. The liquid dispenser recited in claim 1, wherein said liquid dispensing valve includes a flap closure pivotally connected at one end thereof to said liquid dispensing head and a pushing arm extending from said flap closure to receive said pushing force applied thereto for causing said flap closure to pivot relative to said liquid dispensing head from said closed position to said open position to create a gap past said flap closure to the liquid collection area within said liquid dispensing head so that the at least some liquid delivered to said liquid collection area is dispensed through said gap to the location outside said flexible outer shell.

11. The liquid dispenser recited in claim 10, wherein the flap closure of said liquid dispensing valve has a spring memory.

12. A liquid dispenser, comprising:

a flexible reservoir in which a liquid is stored;

a flexible outer shell surrounding said flexible reservoir;

a liquid dispensing valve lying, in fluid communication with said flexible reservoir, said liquid dispensing valve having as closed position for blocking the flow of the liquid from said flexible reservoir to a location outside said flexible outer shell;

an emitter located outside said flexible outer shell and extending between said flexible reservoir and said liquid dispensing valve and having a flow path running therethrough by which at least some of the liquid stored in said flexible reservoir is supplied under pressure to said liquid dispensing valve when a squeezing three is applied to said flexible outer shell and transmitted to said flexible reservoir, said liquid dispensing valve having a flap closure that is responsive to a pushing force applied thereagainst, whereby to cause said flap closure to move from a closed position to an open position for permitting the flow of the at least some liquid from said flexible reservoir to the location outside said flexible outer shell; and a liquid dispensing head positioned at the exterior of said flexible outer shell to surround said emitter, the flap closure of said liquid dispensing valve being pivotally connected to said liquid dispensing head so that said flap closure is rotatable in response to said pushing force applied thereagainst whereby to rotate inwardly of said fluid dispensing head to said open position to create a gap in said liquid dispensing head so that fluid flows from said flexible reservoir to the location outside said flexible shell by way of the flow path through said emitter and the gap in said liquid dispensing head.

13. The liquid dispenser recited in claim 12, wherein there is a liquid collection area located within said liquid dispensing head and communicating with said liquid emitter such that the at least some liquid is delivered from said flexible reservoir to said liquid collection area via the flow path running through said emitter, said liquid dispensing valve dispensing the at least some of the liquid from the liquid collection area within said liquid dispensing head through the gap formed in said liquid dispensing head when the flap closure of said liquid dispensing valve is moved to said open position inwardly of said head.

* * * * *